US006530184B1

(12) United States Patent
Emek

(10) Patent No.: US 6,530,184 B1
(45) Date of Patent: Mar. 11, 2003

(54) BLAST RESISTANT FRAMEWORK

(75) Inventor: Mordechay Emek, Kfar Shmariyabu (IL)

(73) Assignee: Arpal Aluminum Ltd., Lod (IL)

( * ) Notice: Subject to any disclaimer, the term of this patent is extended or adjusted under 35 U.S.C. 154(b) by 0 days.

(21) Appl. No.: 09/401,175

(22) Filed: Sep. 22, 1999

(30) Foreign Application Priority Data

Nov. 26, 1998 (IL) ..... 127265

(51) Int. Cl.[7] ..... E06B 5/12

(52) U.S. Cl. ..... 52/204.591; 52/204.62; 52/204.72

(58) Field of Search ..... 52/208, 204.591, 52/504.597, 204.62, 656.7, 656.5, 656.6, 204.71, 204.72

(56) References Cited

U.S. PATENT DOCUMENTS

| | | | | | |
|---|---|---|---|---|---|
| 1,288,830 | A | * | 12/1918 | Carlough, Jr. et al. | 52/656.6 |
| 2,128,870 | A | * | 8/1938 | Woelfel | 52/204.593 |
| 4,132,035 | A | | 1/1979 | Frambach | 49/484 |
| 4,321,777 | A | * | 3/1982 | Sauret et al. | 52/204.595 |
| 5,412,922 | A | * | 5/1995 | Vittori et al. | 52/208 |
| 5,560,149 | A | | 10/1996 | Lafevre | 49/501 |
| 5,636,484 | A | * | 6/1997 | DeBlock | 52/204.72 |
| 5,709,055 | A | | 1/1998 | Levi | 52/204 |
| 5,747,170 | A | * | 5/1998 | Von Alpen et al. | 52/208 |
| 5,765,325 | A | * | 6/1998 | DeBlock | 52/204.72 |
| 6,216,401 | B1 | * | 4/2001 | Emek | 52/204.72 |

FOREIGN PATENT DOCUMENTS

| | | |
|---|---|---|
| DE | 8007525 | 7/1980 |
| DE | 4142151 | 7/1993 |
| FR | 2584128 | 1/1987 |

* cited by examiner

*Primary Examiner*—Michael Safavi
(74) *Attorney, Agent, or Firm*—Ladas & Parry

(57) ABSTRACT

A blast resistant framework for a window, comprising a frame fitted within an opening of a wall or the like and a window sash assembly holding a window pane mounted on the frame in a rigid and air-tight manner. The window sash assembly comprises an L-like shaped pane-supporting profile circumferencing the window pane and having a first leg portion extending along the edges of the pane and a second leg portion extending along peripheries of the window at an inner face thereof. The window pane is attached to the pane-supporting profile by a flexible adhesive material applied at least to the first leg portion of the profile.

11 Claims, 5 Drawing Sheets

BLAST RESISTANT FRAMEWORK

FIELD OF THE INVENTION

The present invention is in the field of blast resistant frameworks for windows and in particular it is directed to a method for attaching a glass pane to a profiled sash of blast resistant windows.

BACKGROUND OF THE INVENTION

Casement windows with which the present invention is concerned typically comprise a rectangular (sometimes a polygonal, arced or the like) framework consisting of a frame anchored within an opening in a wall and a sash swingably mounted thereon with suitable locking means preventing unintended opening of the sash.

The evergrowing threat of chemical/ biological war in some regions in the world, has led to some recent requirements to provide blast-resistant gas-tight windows. Even more so, conventional explosions caused either by explosive charges or accidentally at industrial facilities, also require protecting people within structures by blast-resistant windows. The term "blast-resistant window" indicates on the one hand, that the glass pane of such a window will withstand a blast caused by an explosion and, on the other hand, indicates that the framework is resistant and will deform only up to a restricted limit to prevent injury of people within a room.

Designing blast-resistant windows involves several considerations, namely the durability of the glass pane, resistance of the hinge and locking assemblies, durability of the framework and means for attaching the glass pane to the framework. The present invention is concerned with the latter.

The problem involved with attaching the glass pane to the framework is that most of the blast's energy is received by the glass pane, that owing to its significant surface area as compared with other components of the window. The outcome is that a majority of bending and shearing forces act between the glass pane and the framework supporting it. Accordingly, it is desired to provide some damping means for absorbing the blast energy in order to prevent portions of the framework or window pane to break or deform in a manner which might be hazardous to individuals in a room.

One solution is disclosed in co-pending Israel Patent Application No. 123980 owned by Arpal Aluminum Ltd., in which there is provided damping means adapted for intentional deformation of profiles so as to absorb the blast's pressure energy.

However, arrangements as described in that disclosure referred to constructional profile elements adapted for mechanical deformation. Such elements, apart from increasing the overall weight of the framework, are also expensive and more complex in construction.

It is an object of the present invention to provide a new and improved method for attaching a glass pane to a framework of a blast-resistant window in which the above desiderata are fulfilled and in which the above drawbacks are significantly reduced or overcome.

SUMMARY OF THE INVENTION

According to the present invention there is provided a blast resistant framework for a window, the framework comprising a frame fitted within an opening of a wall or the like, and a window sash assembly holding a window pane mounted on the frame in a rigid and air-tight manner;

the invention characterized in that the window sash assembly comprises an L-like shaped pane-supporting profile, said profile circumferencing the window pane and having a first leg portion extending along side edges of the pane and a second leg portion extending along peripheries of the window at an inner face thereof; wherein the window pane is attached to the pane-supporting profile by an essentially flexible adhesive material applied at least to the first leg portion of said profile.

The reinforced window pane is preferably a bullet, attack and blast resistant material or sandwich of materials, offering protection against vandalism (physical attack), kinetic energy of bullet and shrapnel, and blast.

Typically, a window with which the invention is concerned is a casement window. However, it should be noticed that the invention is not restricted thereto.

In accordance with a preferred embodiment of the invention, the adhesive material is a Low Modulus Silicone.

In accordance with one specific embodiment, the adhesive material is applied also along the second leg portion of the pane-supporting profile.

By still another embodiment, there is further provided a front-support profiled portion extending along peripheries of the window pane at an outer face thereof. Alternatively, the front-support profiled portion is fixedly attached to the pane-supporting profile.

By another application, the front-support profiled portion is integral with, or fixedly attached to a profile of the frame.

Preferably there is provided a resilient seal member extending between the front-support profiled portion and the window pane, sealingly received therebetween.

BRIEF DESCRIPTION OF THE DRAWINGS

For better understanding, the invention will now be described by way of example only, with reference to the accompanying drawings, in which.

DETAILED DESCRIPTION OF THE PREFERRED EMBODIMENTS

Figure 1:
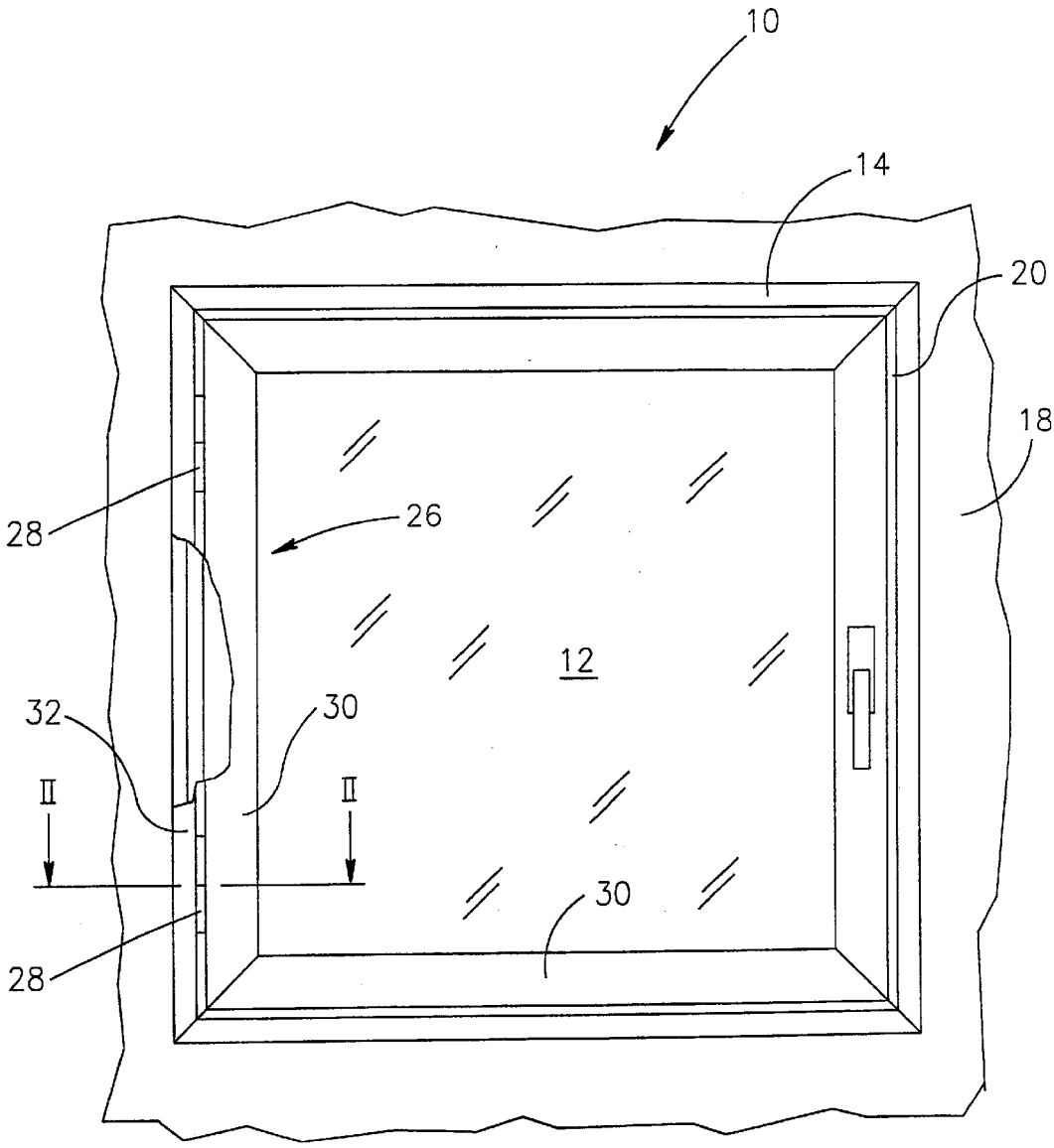
FIG. 1 is a front elevation of a casement window according to the present invention viewed from an interior side thereof.
Figure 2:
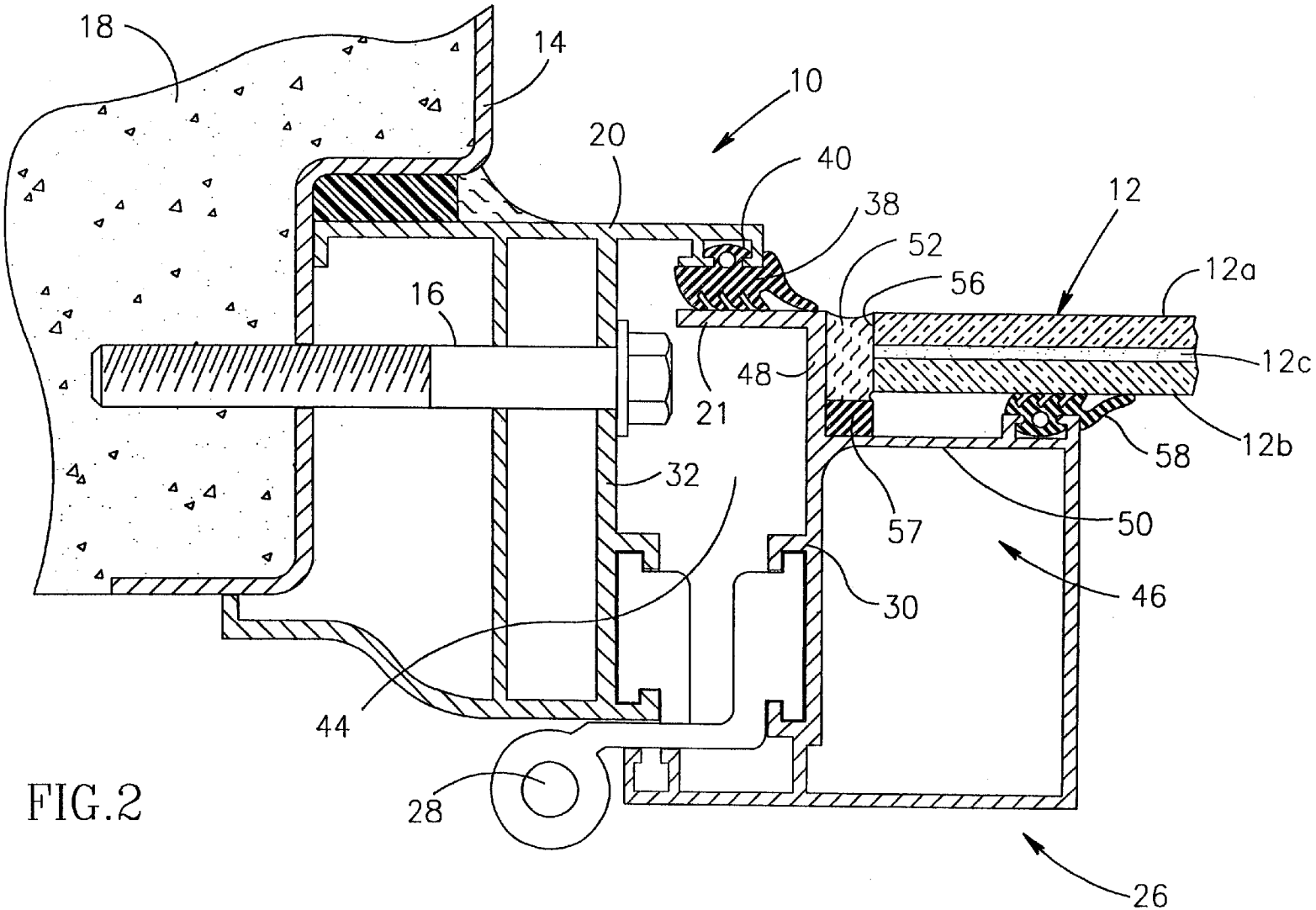
FIG. 2 is a horizontal cross-sectional view of the window shown in FIG. 1, taken along line II—II, illustrating a first embodiment of the present invention.

Reference is first made to FIGS. 1 and 2 of the drawings, illustrating a rectangular framework generally designated 10 holding a blast resistant window pane 12. An optional construction frame 14 is anchored within a corresponding rectangular aperture formed in wall 18 (see FIG. 2) by known means.

Typically, with a construction in accordance with the present invention, the window pane 12 is of a generally known reinforced type suitable for withstanding vandalism (physical attack), explosion blast and kinetic energy of bullets and shrapnel.

A frame 20 made of light metal such as aluminum is fixed to frame 14 by bolts as known per se. The framework 10 further comprises a window sash generally designated 26 which consists of profiled rails pivotally mounted with respect to inner frame 20 by means of hinges 28 secured respectively to the hanging jamb 30 and the hanging stile 32.

The means and method for reinforced mounting of the construction frame 14 to the wall as well as the means for fixing the frame 20 to construction 14 and pivotally supporting the window sash to the window frame including the locking mechanism and hinges are well known and are described, for example in Israel Patent No. 103168. Glass pane 12 is also of known construction and consists of two layers of glass 12*a* and 12*b* with an intermediate layer of flexible resin 12*c*, as required in accordance with different standards. However, other blast resistant window panes are available.

A resilient rubber seal member 38 is received within a suitable groove 40 extending from frame 20 bears against an extension portion 21 of profile 30 and serves as a seal when the window is in the closed position, as seen in FIGS. 2–5. Additional sealing means may be provided in the cavity 44 formed in the window's closed position between the jamb 30 and hanging stile 32, as known per se.

Window sash 26 comprises an L-like shaped pane supporting profile portion designated 46 consisting of a first leg portion 48 and a second leg portion 50. Window pane 12 is attached to the pane supporting profile by an essentially flexible adhesion material 52 applied between the first leg portion 48 and the circumferential edges 56 of window pane 12.

An adhesive material which was found to be suitable for attaching the window pane 12 to the profiled supporting member is of the type having the following technical specifications:

Expansion coefficient—about 0.35%;

Shore Hardness Number—about up to 25;

Tensile strength of about between 0.8 to 1.2 Mpa;

Movement factor of about between 40–70%;

Thickness of adhesive layer is at least about 3–8 mm.

Such an adhesive member is typically of the so-called Low Modulus Silicone. Examples of such commercial products are Arbosil™ 1090 and Arbosil™ 1096 manufactured by Arbo.

Experiments have shown that attaching a window pane to the pane-supporting profile will withstand a shock wave of about 40 Psi, as required by some specifications.

As further seen in FIG. 2, profiled pane support portion 46 is fitted with a profiled member 57 extending almost flush with the interior surface of the window pane 12 and adapted to prevent flow of the adhesive material 52 when applied. Profile 57 may be adhered to the supporting profile.

Further seen there is a resilient rubber seal member 58 extending between leg portion 50 and window pane 12 for improved sealing and support therebetween.

Figure 3:
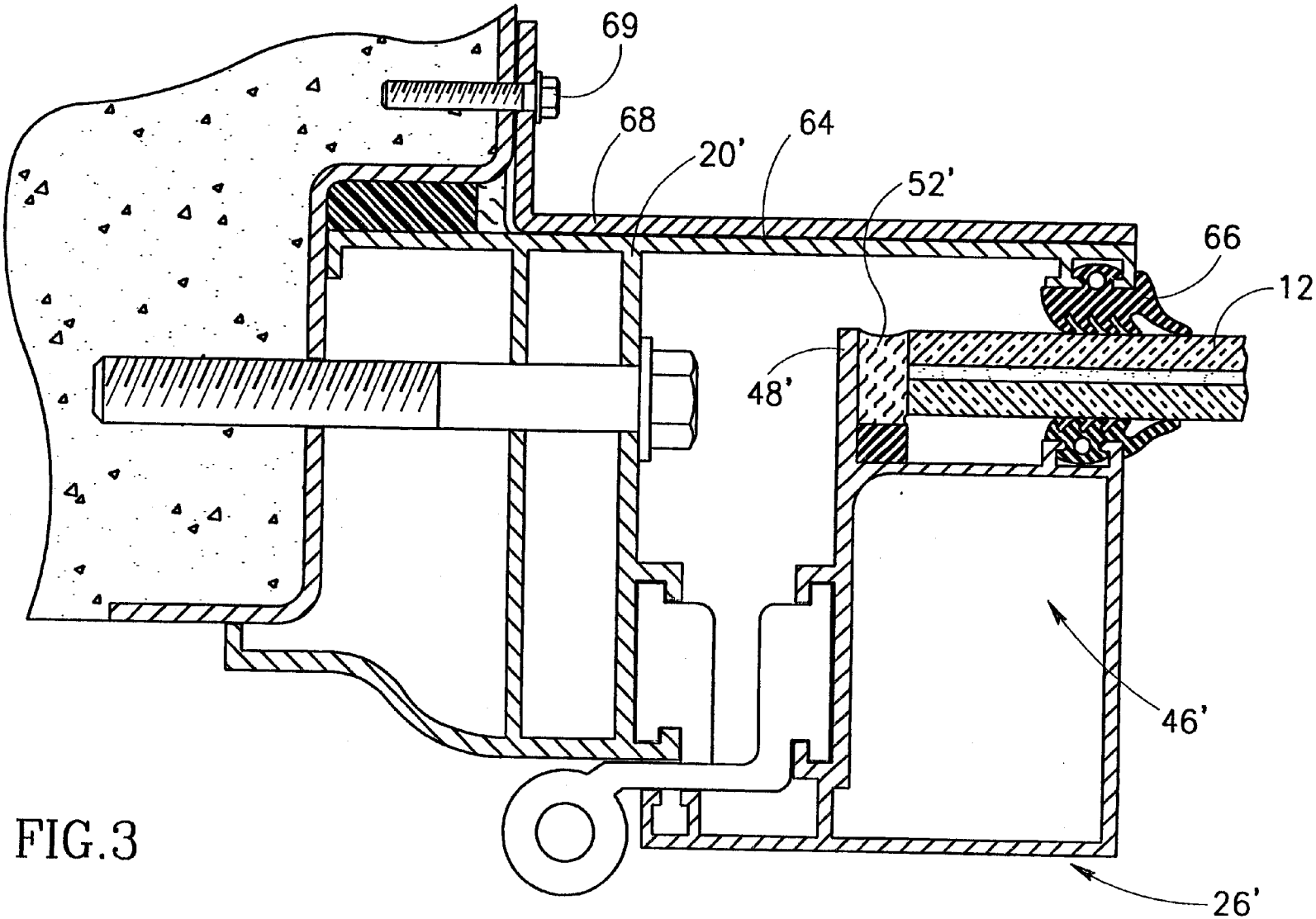
FIGS. 3 to 5 are horizontal cross-sectional views of the window shown in FIG. 1, taken along line II—II, illustrating modifications of the invention in accordance with the present invention.
Figure 4:
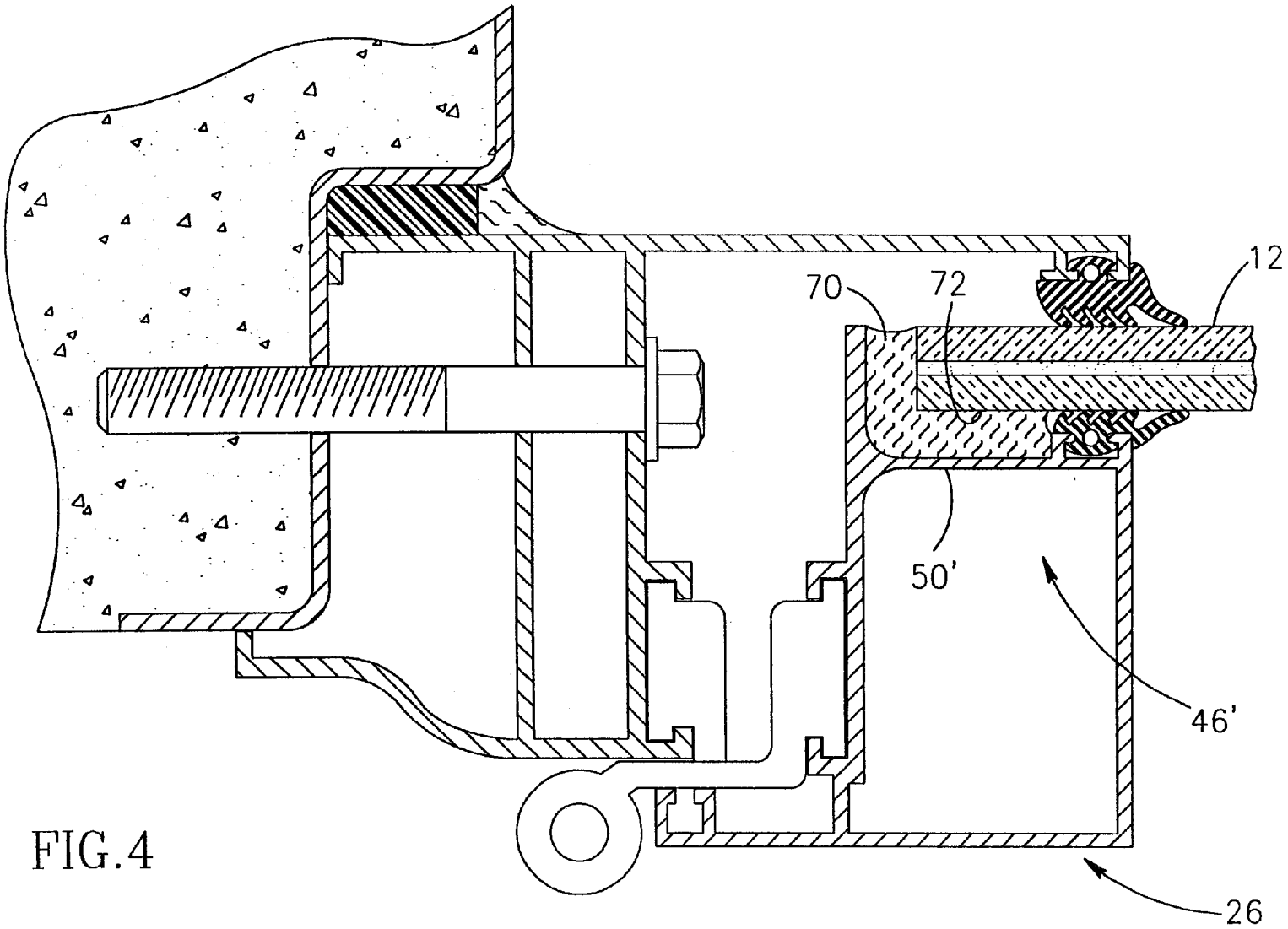
Figure 5:
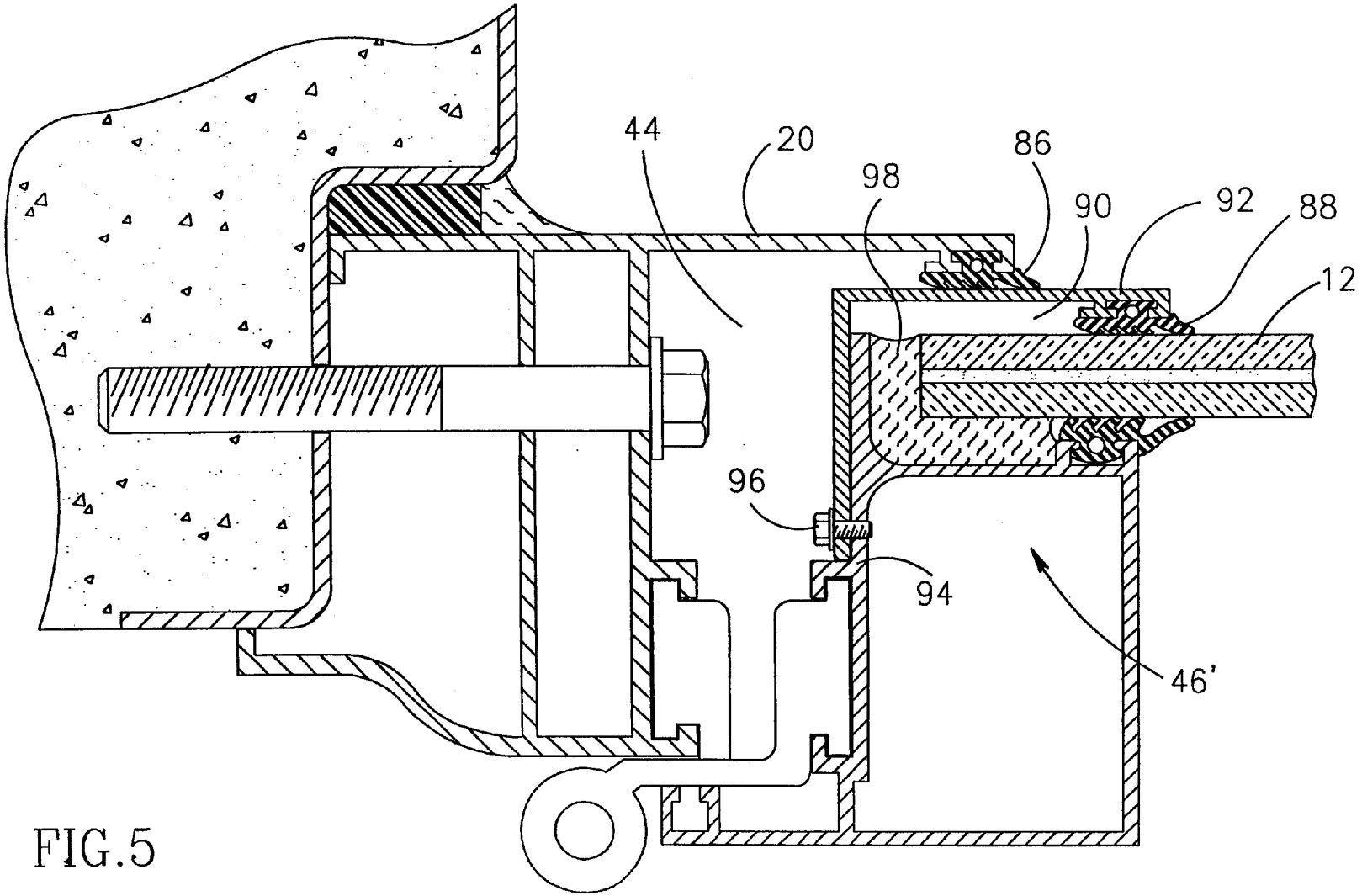

For the sake of clarification and simplification, those components of FIGS. 3–5 which are similar to corresponding elements in FIGS. 1 and 2 will be indicated by the same reference number with a prime indication.

The embodiment of FIG. 3 differs from the embodiment of FIG. 2 in that the frame 20', comprises an extended profiled portion 64 fitted at an end thereof with a resilient seal 66 bearing against the exterior surface of window pane 12. It is noted, however, that window pane 12 is attached to the sash 26' in a similar manner as in FIG. 2, i.e. by applying a layer of adhesive substance 52' between the edges of the window pane 12 and a leg portion 48' of the pane-supporting profiled portion 46'.

Seal 66 has the same purpose as of seal 38 in FIG. 2, namely, to provide a gas-tight sealing between the profiled sections of the framework.

As can further be seen in FIG. 3, a protective L-shaped profile 68 is attached to the wall by means of bolts 69 and is adapted for protecting the frame 20 from the formation under blast, from bullets, shrapnel, etc. Typically, the protective profile is made of hardened material such as steel, etc.

Attention is now directed to FIG. 4 which in construction is similar to the embodiment of FIG. 3. However, the difference resides in that the adhesive substance 70 is applied along the edges of pane 12 as well as along an interior peripheral circumferential portion 72 of pane 12, for adhering to corresponding leg portions 48' and 50' respectively. This arrangement provides improved attachment of the pane to the pane-supporting profile 46', as can readily be understood.

In the embodiment shown in FIG. 5 cavity 90 is defined between the L-like shaped profile 46' and an additional arm profile 92 secured to profile portion 94 by bolt 96. This arrangement allows easier application of the adhering substance 98.

It is noted that the cavity 44 between the frame 20 and the sash 26' is sealed by sealing member 86 bearing against arm 92 of sash 26'. An additional sealing member 88 is provided between pane 12 and the support arm 78.

The purpose of the external support arms 64 and 92 as represented in FIGS. 3 and 5, respectively, is to provide some external support for the window pane 12. This support is important for preventing the window pane from displacement outwardly as a result of a blast shock wave acting to displace the window in that direction. This external support is important in particular at pressure exceeding about 15 Psi.

While some preferred embodiments have been shown and illustrated, it is to be understood by a skilled person that it is not intended thereby to limit the disclosure, but rather it is intended to cover all modifications and arrangements falling within the spirit and scope of the present invention, mutatis mutandis. For example, the adhering material in FIG. 5 may be applied only to one leg portion of the pane supporting profile, as explained hereinabove.

What is claimed is:

1. A blast resistant window framework comprising a frame mounted within an opening of a wall and a window sash assembly mounted on said frame and holding a window pane, wherein said window pane having at least two layers of glass laminated together with an intermediate layer of flexible resin without an air space between the glass layers, wherein the improvement comprises:

said window sash including an l-shaped pane supporting profile circumferencing said window pane and having a first leg portion extending along side edges of said window pane and a second leg portion extending along peripheries of an inner face of said window pane;

flexible adhesive material absorbing blast energy and dampening the blast effect on said window pane and said frame, and being applied between said first leg portion and a circumferential edge of said window pane;

a profiled member adhered to said l-shaped profile, extending almost flush with an interior surface of said window pane, and preventing flow of said flexible adhesive material; and a resilient rubber seal member extending between said second leg of said profile and said interior surface of said window pane, and providing sealing and support between said profile and said window pane;

wherein said blast resistant framework absorbs blast energy to prevent portions of the framework and window pane from breaking or deforming in a manner that may be hazardous to individuals in the vicinity of the window framework.

2. A blast resistant window according to claim 1, wherein the adhesive material is a Low Modulus Silicone.

3. A blast resistant window according to claim 1, wherein the thickness of the adhesive material is at least 3–8 mm.

4. A blast resistant window according to claim 1, wherein there is further provided a front-support profiled portion extending along peripheries of the window pane at an outer face thereof.

5. A blast resistant window according to claim 4, wherein the front-support profiled portion is fixedly attached to the pane-supporting profile.

6. A blast resistant window according to claim 4, wherein the front-support profiled portion is integral with, or fixedly attached to a profile of the frame.

7. A blast resistant window according to claim 4, wherein the front-support profiled portion is fitted with a resilient seal bearing against the window pane.

8. A blast resistant window according to claim 2, wherein the adhesive material has a movement factor of about between 40–70%.

9. A blast resistant window according to claim 2, wherein the adhesive material has an expansion coefficient of about 0.35%.

10. A blast resistant window according to claim 2, wherein the adhesive material has a Shore Hardness Number of about up to 25.

11. A blast resistant window according to claim 2, wherein the adhesive material has a tensile strength of about between 0.8 to 1.2 Mpa.

* * * * *